US005868526A

United States Patent [19]

Caulder

[11] Patent Number: 5,868,526

[45] Date of Patent: Feb. 9, 1999

[54] TRENCH SHIELD

[76] Inventor: Richard Austin Caulder, 2833 Calder Rd., Marion, S.C. 29571

[21] Appl. No.: 726,788

[22] Filed: Oct. 7, 1996

[51] Int. Cl.[6] ..... E02D 17/00

[52] U.S. Cl. ..... 405/283; 405/272

[58] Field of Search ..... 405/272, 273, 405/274, 276, 282, 283, 157

[56] References Cited

U.S. PATENT DOCUMENTS

| | | | |
|---|---|---|---|
| 2,922,283 | 1/1960 | Porter . | |
| 3,089,310 | 5/1963 | Torti . | |
| 3,715,889 | 2/1973 | Bixler et al. | 405/283 |
| 3,782,126 | 1/1974 | Pavese | 405/282 |
| 4,019,330 | 4/1977 | Griswold . | |
| 4,033,138 | 7/1977 | Griswold | 405/283 |
| 4,752,157 | 6/1988 | Ischebeck et al. . | |
| 4,993,880 | 2/1991 | Collins . | |
| 5,232,312 | 8/1993 | Jennings et al. . | |
| 5,277,522 | 1/1994 | Pertz . | |
| 5,290,129 | 3/1994 | Rody et al. . | |
| 5,310,290 | 5/1994 | Spencer . | |
| 5,503,504 | 4/1996 | Hess et al. . | |
| 5,527,137 | 6/1996 | Spencer . | |

FOREIGN PATENT DOCUMENTS

| | | |
|---|---|---|
| 2615218 | 11/1988 | France . |
| 3820625 | 1/1989 | Germany . |
| 2094373 | 9/1982 | United Kingdom . |
| 2115453 | 9/1983 | United Kingdom . |
| 2171735 | 1/1986 | United Kingdom . |

OTHER PUBLICATIONS

Efficiency Production, Inc. *Trench Shields, Bedding Containers, Portable Water Systems* catalog, 1991.

*Primary Examiner*—Tamara L. Graysay
*Assistant Examiner*—Frederick L. Lagman
*Attorney, Agent, or Firm*—Richard C. Litman

[57] ABSTRACT

A trench shield or manhole shield which has tapered side shields. The walls of each side shield are tapered. The outer walls are tapered inwardly from front to rear (in the case of the trench shield) or from top to bottom (in the case of a manhole shield). This taper allows the shield to be pulled out of an excavated hole by reducing friction because the trailing portion of the shield is tapered inwardly and does not contact the sides of the hole. The inner wall of each side shield of the trench shield is tapered outwardly from front to rear, further reducing friction. In different embodiments either the outer or the inner walls or both are tapered.

9 Claims, 3 Drawing Sheets

FIG. 5
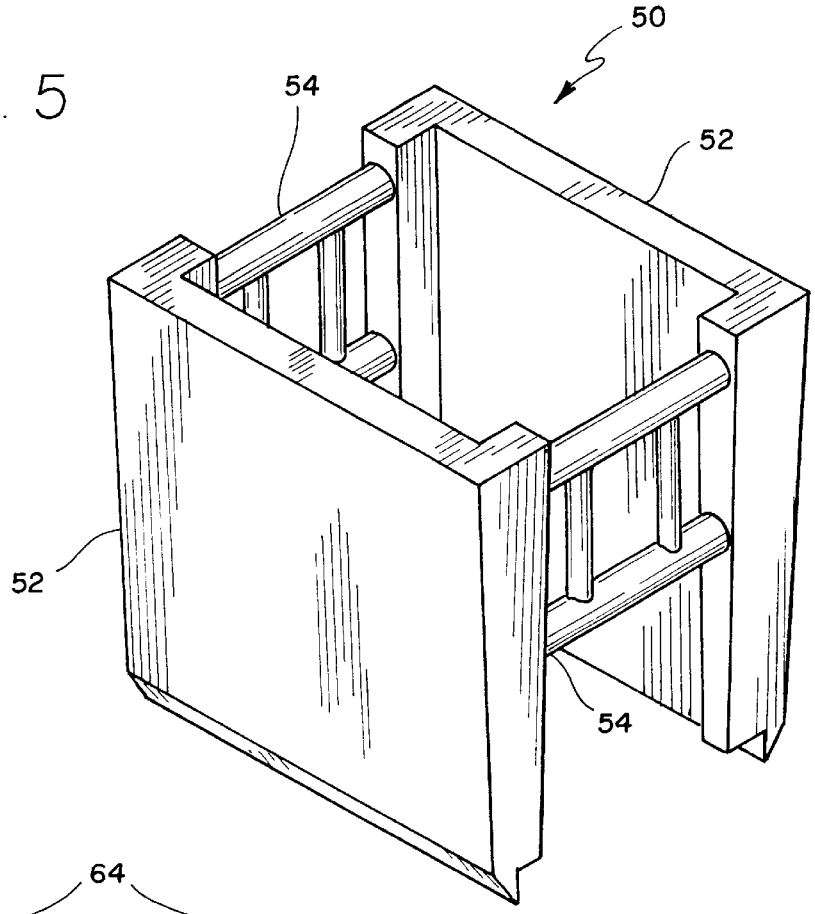
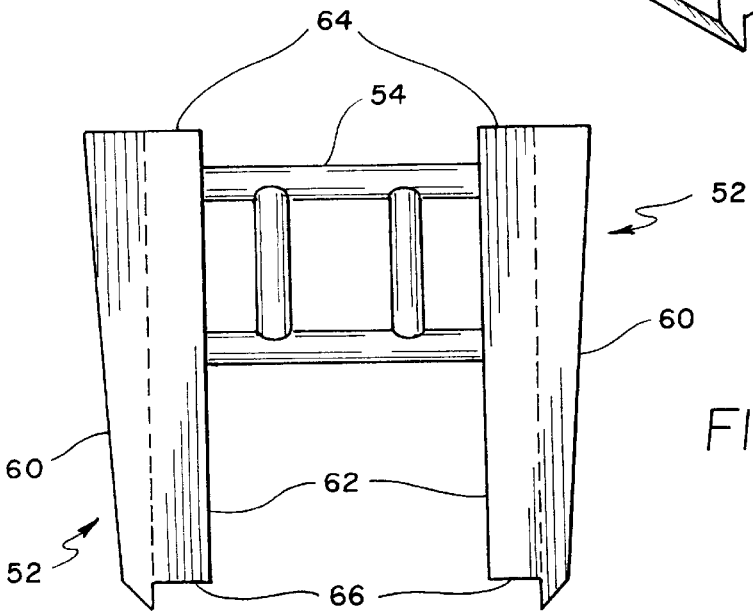
FIG. 6

TRENCH SHIELD

BACKGROUND OF THE INVENTION

1. Field of the Invention

The present invention relates to trench shields and manhole shields.

2. Description of the Prior Art

Trench shields and manhole shields are designed to protect workers in deep excavations, e.g. when laying pipe, from a slope failure of an exposed earth wall. In laying pipe, a pipe joint is laid and the space within the trench or manhole shield is partially backfilled and compacted. The shield is then pulled forward in order to lay the next section of pipe. Frictional forces resulting from the pressures of the soil collapsing against the exterior walls of the shield and the material backfilled and compressed against the interior walls of the shield exist. These forces must be overcome in order to advance the shield in a trench or extract it.

Previous patents, for example U.S. Pat. No. 2,922,283, issued on Jan. 26, 1960 to F. S. Porter, U.S. Pat. No. 3,089,310, issued on May 14, 1963 to E. Torti, U.S. Pat. No. 4,019,330, issued on Apr. 26, 1977 to James L. Griswold, U.S. Pat. No. 4,752,157, issued on Jun. 21, 1988 to Ernst-Friedrich Ischebeck et al., U.S. Pat. No. 4,993,880, issued on Feb. 19, 1991 to John Collins, U.S. Pat. No. 5,232,312, issued on Aug. 3, 1993 to Charles B. Jennings et al., U.S. Pat. No. 5,277,522, issued on Jan. 11, 1994 to Joseph F. Pertz, U.S. Pat. No. 5,290,129, issued on Mar. 1, 1994 to Kenneth G. Rody et al., U.S. Pat. No. 5,310,290, issued on May 10, 1994 to Dennis I. Spencer, U.S. Pat. No. 5,503,504, issued on Apr. 2, 1996 to Wilhelm Hess et al., and U.S. Pat. No. 5,527,137, issued on Jun. 18, 1996 to Dennis I. Spencer, Great Britain Patent Nos. 2,094,373, published on Sep. 15, 1982, 2,115,453, published on Sep. 7, 1983, and 2,171,735, published on Jan. 22, 1986, French Patent No. 2,615,218, issued on Nov. 18, 1988, and German Patent No. 3,820,625, issued on Jan. 5, 1989, teach shoring devices and machines. Further, the *Efficiency Production, Inc.* brochure, published in 1991, teaches trench shields.

These prior trench shields all suffer from the above-noted disadvantage, namely that frictional forces must be overcome, e.g. by the use of heavy equipment. The shields of the instant invention have tapered side shields, thereby resulting in reduced frictional forces as they are advanced forward in the trench or extracted from the trench.

SUMMARY OF THE INVENTION

The instant invention is a trench shield or manhole shield which has tapered side shields. The walls of each side shield are tapered. The outer walls are tapered inwardly from front to rear (in the case of the trench shield) or from top to bottom (in the case of a manhole shield). This taper allows the shield to be pulled out of an excavated hole by reducing friction because the trailing portion of the shield is tapered inwardly and does not contact the sides of the hole. The inner wall of each side shield of the trench shield is tapered outwardly from front to rear, further reducing friction. In different embodiments either the outer or the inner walls or both are tapered.

Accordingly, it is a principal object of the invention to provide a trench shield or manhole shield that can be more easily handled, i.e., that allows for the use of smaller excavating equipment.

It is another object of the invention to provide a trench shield or manhole shield that can be moved without the disturbance of backfill material and which allows a greater depth of backfilling.

It is still another object of the invention to provide a trench shield or manhole shield that eliminates the potential for joint separation in laying pipe when the shield is moved (due to the reduced friction).

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 5 is perspective view of a manhole shield with its outer wall tapered; and FIG. 6 is a front view of a the manhole shield of FIG. 5.

Similar reference characters denote corresponding features consistently throughout the attached drawings.

DETAILED DESCRIPTION OF THE PREFERRED EMBODIMENTS

Figure 1:
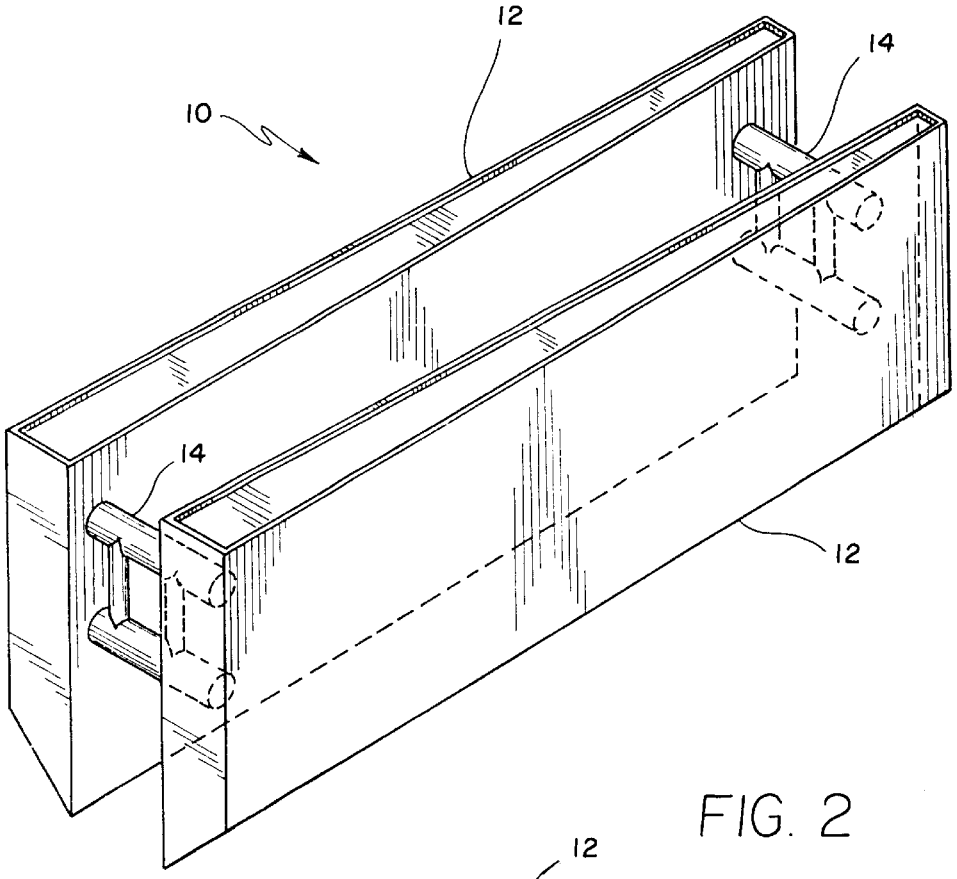
FIG. 1 is perspective view of a trench shield with its outer walls tapered.

FIGS. 1–4 show trench shields 10 which are used in a horizontal excavation, i.e., one that is longer than it is deep for laying pipe horizontally. The trench shields 10 include a pair of side shields 12,12 attached and separated by pipe spreaders 14,14 at either end of the side shields 12,12. The side shields 12,12 are tapered such that the front wall 24 of each shield 12 is longer than the rear wall 26, thereby reducing friction when the trench shield 10 is removed from the excavation.

Figure 2:
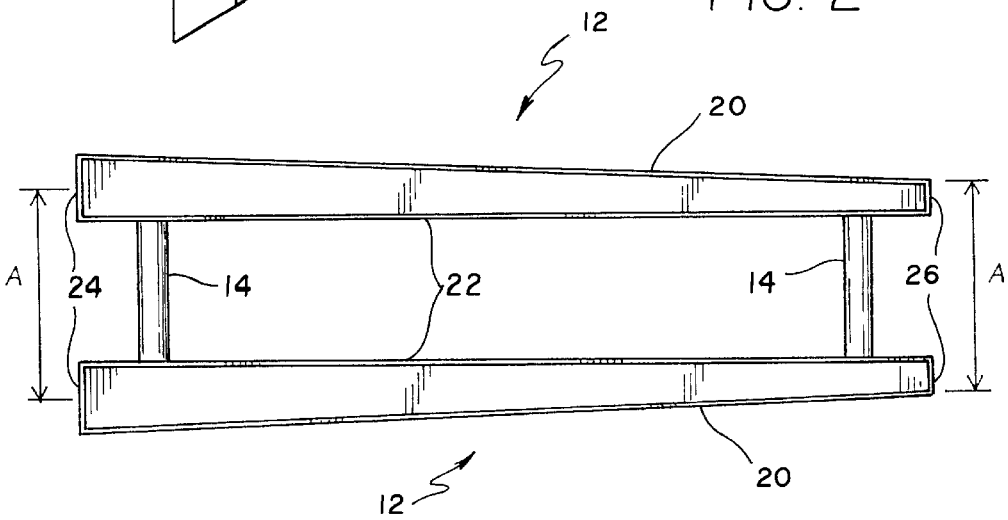
FIG. 2 is a top view of the trench shield of FIG. 1.
Figure 3:
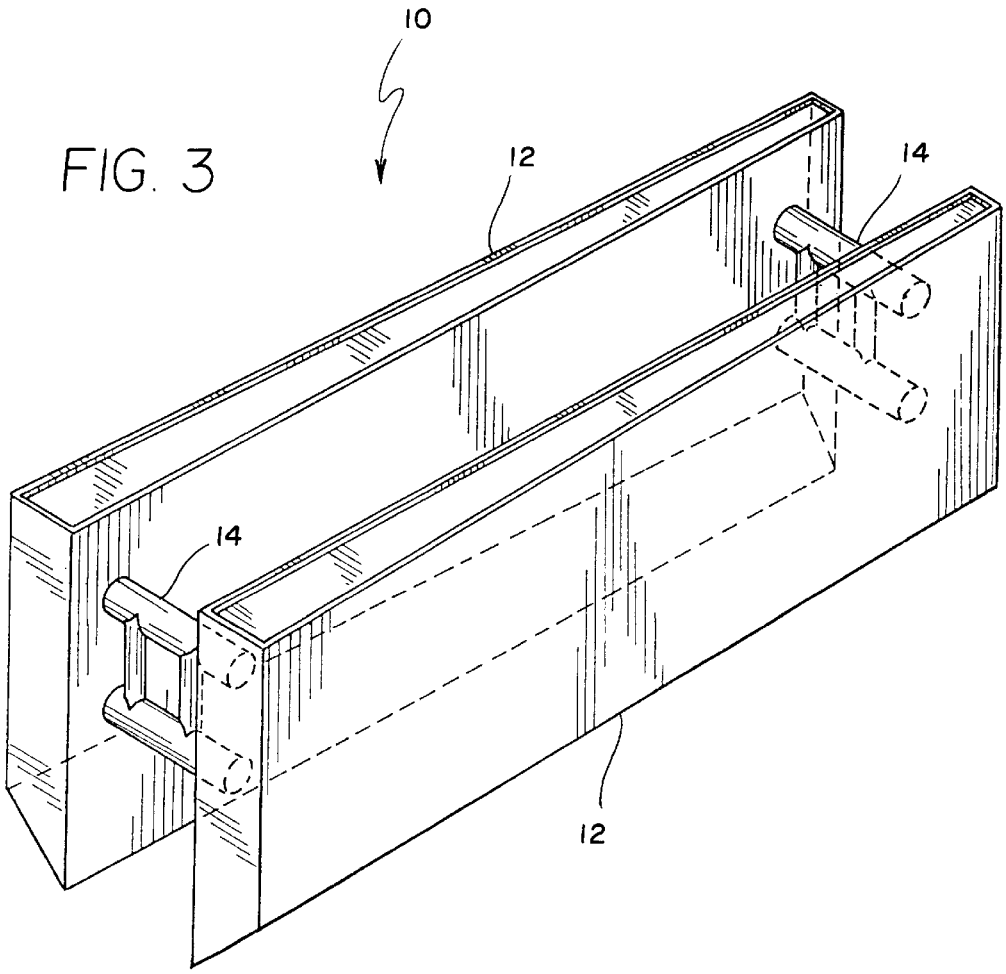
FIG. 3 is perspective view of a trench shield with its inner and outer walls tapered.
Figure 4:
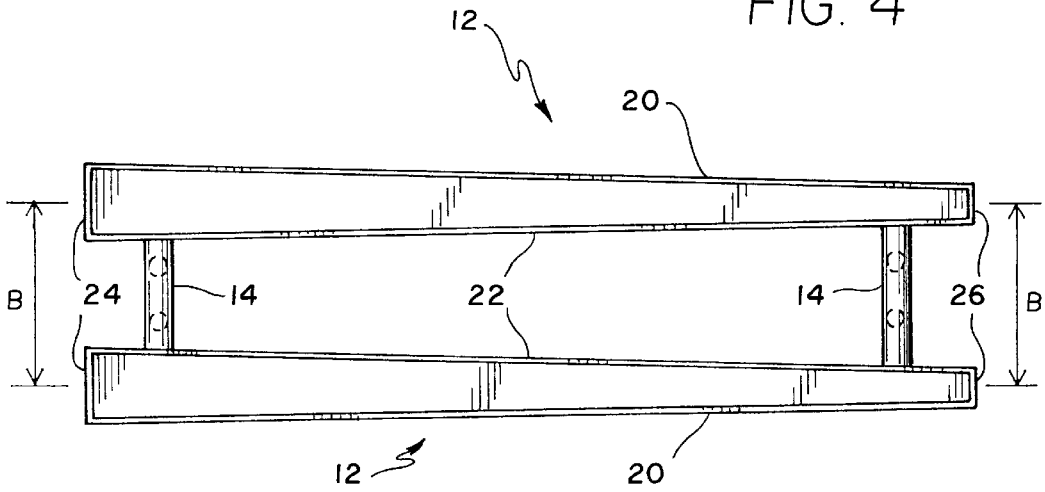
FIG. 4 is a top view of the trench shield of FIG. 3.

The outer wall 20 of each side shield 12 can be tapered inwardly to reduce the friction due to soil collapsing against the outer wall 20. This embodiment is shown in FIGS. 1 and 2 and the taper is depicted by comparing distance A at the front of the trench shield 10 to its equivalent distance A at the rear of the trench shield 10 (FIG. 2). In another embodiment, the inner wall 22 of each side shield can be tapered outwardly to reduce the friction due to the backfill against the inner wall 22. This embodiment is not shown but can be appreciated in the embodiment where both the outer and inner walls 20 and 22 are tapered to reduce both of these types of friction. This last embodiment is shown in FIGS. 3 and 4 in which both the outer and the inner walls 20 and 22 are tapered (shown by distance B in FIG. 4). The degree of taper, the length and width of the trench shield 10, and the reinforcement of the side shields 12,12 (which may be steel I-beams) will vary based on engineering calculations, the type of excavation, the type of soil, etc.

FIGS. 5 and 6 shows another type of trench shield. The manhole shield 50 operates as a trench shield used in a vertical orientation, i.e., the excavation is deeper than it is long. Like the horizontal trench shield 10, the manhole shield 50 has a pair of side walls 52,52 separated by a pair of pipe spreaders 54,54. The side walls 52,52 have outer and inner walls 60 and 62, either or both of which may be tapered for the reasons of reducing friction and having the advantages discussed above with respect to the horizontal trench shield 10. FIG. 6 shows the outer walls 60,60 tapered inwardly from top walls 64,64 to shorter bottom walls 66,66.

It is to be understood that the present invention is not limited to the embodiments described above, but encompasses any and all embodiments within the scope of the following claims.

I claim:

1. In a trench shield having a pair of side shields and having devices to attachably separate said pair of side shields from one another, each of said side shields having an inner and an outer wall, a front and a rear wall, wherein the improvement comprises said outer wall of each of said side shields tapering inwardly from said front wall to said rear wall.

2. The trench shield of claim 1, wherein said inner wall of each of said side shields is tapered.

3. The trench shield of claim 2, wherein said inner wall of each of said side shields tapering outwardly from said front wall to said rear wall.

4. In a trench shield having a pair of shields and having devices to attachably separate said pair of shields from one another, each of said shields having an inner and an outer wall, a top and bottom wall, wherein the improvement comprises said outer wall of each of said shields tapering inwardly from said top wall to said bottom wall.

5. A shoring system comprising a trench shield having a pair of side shields and having devices to attachably separate said side shields from one another, each of said side shields having an inner and an outer wall, a front and a rear wall, said outer wall of each of said side shields tapering inwardly from said front wall to said rear wall.

6. The shoring system of claim 5, said inner wall of each of said side shields tapering outwardly from said front wall to said rear wall.

7. In a trench shield having a pair of shields and having devices to attachably separate said shields from one another, each of said shields having an inner, outer, front, rear, top, and bottom walls, the improvement comprising at least one of said inner and outer walls being tapered such that there is an inequality in one of: the length of the front and rear walls; and the top and bottom walls.

8. The trench shield of claim 7, wherein the length of said front wall is greater than the length of said rear wall.

9. The trench shield of claim 7, wherein the length of said top wall is greater than the length of said bottom wall.

* * * * *